United States Patent [19]

Feingold

[11] Patent Number: 4,602,447

[45] Date of Patent: Jul. 29, 1986

[54] WINDOW ENVELOPE FOR CARD FILE HAVING GUIDE RAILS

[76] Inventor: Irene B. Feingold, 355 Warren Rd., Rochester, N.Y. 14618

[21] Appl. No.: 605,824

[22] Filed: May 1, 1984

[51] Int. Cl.[4] ..... B42F 5/00

[52] U.S. Cl. ..... 40/405; 40/404; 40/536; 40/537; 40/159

[58] Field of Search ..... 40/400, 401, 536, 405, 40/404, 537, 159, 124.2, 372

[56] References Cited

U.S. PATENT DOCUMENTS

| | | | |
|---|---|---|---|
| D. 250,200 | 11/1978 | Glaubinger | D19/1 |
| D. 258,897 | 4/1981 | Glaubinger | D19/1 |
| 1,454,152 | 5/1923 | Buck | 40/159 |
| 1,487,296 | 3/1924 | Underwood | 40/397 |
| 1,735,524 | 11/1929 | Buzzerd | 40/537 |
| 1,821,876 | 9/1931 | Bonander | 40/536 |
| 2,068,011 | 1/1937 | Engel | 40/405 |
| 2,110,709 | 3/1938 | Limbach | 206/489 |
| 2,296,272 | 9/1942 | De Sherbinin | 206/461 |
| 2,403,701 | 7/1946 | Zuber | 40/534 |
| 2,505,506 | 4/1950 | Sayre | 40/537 |
| 2,574,899 | 11/1951 | Waring | 40/110 |
| 2,639,526 | 5/1953 | Bepristis | 40/536 |
| 3,274,715 | 9/1966 | Janssen | 40/400 |
| 3,651,591 | 3/1972 | Woodyard | 40/537 |
| 4,065,864 | 1/1978 | Stanley | 40/405 |

FOREIGN PATENT DOCUMENTS

| | | | |
|---|---|---|---|
| 2530431 | 3/1976 | Fed. Rep. of Germany | 40/372 |

*Primary Examiner*—Robert Peshock
*Assistant Examiner*—Cary E. Stone
*Attorney, Agent, or Firm*—Stonebraker, Shepard & Stephens

[57] ABSTRACT

A window envelope 10 for a card file having a pair of parallel bottom guide rails includes a back panel 11 and a pair of front panels 12 and 13 formed of transparent resin sheet material and joined together to form a pair of laterally adjacent pockets for storing viewable objects. Seams along the top 21, the lateral sides 22 and 23, and a lower line 24 extending between lateral sides 22 and 23 close three sides of each pocket, and the pocket openings are along a central vertical gap where the edges 32 and 33 of the front panels are spaced apart. Notches 25 in bottom region 26 allow the envelopes to be mounted and leafed in guide rail card holders for filing 35 millimeter slide mounts 15, coins 16, stamps, and other thin objects.

17 Claims, 2 Drawing Figures

WINDOW ENVELOPE FOR CARD FILE HAVING GUIDE RAILS

BACKGROUND

Card files with guide rails such as sold under the ROLODEX name are available in many sizes and styles for many uses. Each card in such a file has a bottom region with a pair of notches that can fit removably over a pair of guide rails so that cards can readily be inserted, removed, and rearranged. Otherwise, the cards can pivot leaf-like on the rails so that the cards can be fingered through for quick access and viewing.

I have devised a window envelope usable with such guide rail card files for storing and filing small, thin objects that are viewably presented. My window envelope reliably holds objects against spilling out of the file and makes the objects easily viewable as the file is leafed through. Also, by being adapted to standard guide rail card files, my viewing envelopes can take advantage of the convenience and versatility of such files.

SUMMARY OF THE INVENTION

My window envelope for a card file having a pair of parallel bottom guide rails includes a back panel having a top, opposite lateral sides, and a bottom region having a pair of notches fitting the rails. Front panels formed of transparent resin material are arranged relative to the back panel to form a pair of laterally adjacent pockets. The front panels are joined to the back panel to close three sides of each pocket, leaving an open side through which objects can be inserted into the pockets to be viewed through the transparent front panels. The closed sides of the pockets extend along the lateral sides, along a lower line extending between the lateral sides above the notches in the bottom region, and preferably along the top so that the front panels can be spaced apart in a central region extending vertically from top to bottom where their open sides confront each other.

DRAWINGS

DETAILED DESCRIPTION

Figure 1:
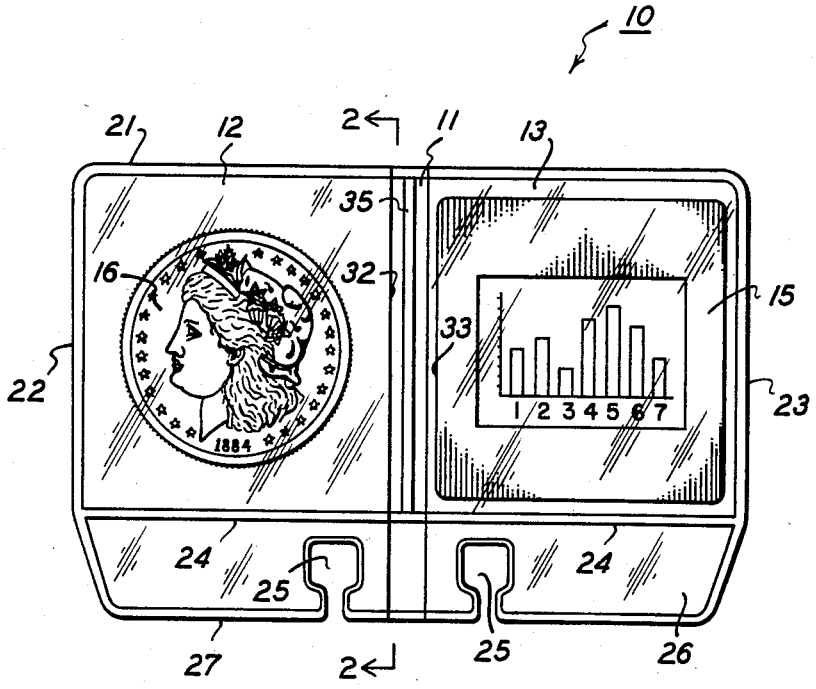
FIG. 1 is a plan view of a preferred embodiment of my window envelope.
Figure 2:
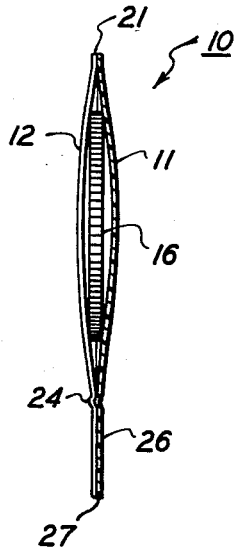
FIG. 2 is a cross-sectional view of the envelope of FIG. 1, taken along the line 2—2 thereof.

My window envelope 10 preferably includes a back panel 11 and a pair of front panels 12 and 13 formed of transparent resin. Front panels 12 and 13 are joined to back panel 11 to form a pair of laterally adjacent pockets for receiving, holding, and making visible suitable objects such as 35 millimeter slide mount 15, coin 16, and stamps or other thin items.

Although back panel 11 can be made of paper or card stock, it also is preferably transparent resin material. The joining of front panels 12 and 13 to back panel 11 is preferably by thermal fusion. A preferred way of making my window envelope is by folding inward the side edge regions of a strip of transparent resin so that the folded-in sides form front panels 12 and 13. Then a heated die can cut out envelope 10 and form the necessary panel fusion bonds in a single stamping cycle for each envelope 10. The details of the resulting window envelope are described below.

The joining of front panels 12 and 13 to back panel 11 occurs along lateral sides 22 and 23, a lower line 24 extending between lateral sides 22 and 23 above notches 25 in bottom region 26, and preferably along upper edge or top 21. This closes three sides of each pocket formed between back panel 11 and front panels 12 and 13. Open edges 32 and 33 for each of the pockets confront each other across a narrow gap extending vertically from top 21 to lower line 24 in a central region where front panels 12 and 13 are spaced apart. Since front panels 12 and 13 are not joined to back panel 11 along open edges 32 and 33, objects can be inserted into the pockets through these confronting openings and viewed through the transparent front panels.

Making the pocket openings confront along a vertical gap helps keep stored objects from spilling out of the pockets, as would be a problem if the pockets opened along lateral edges 22 or 23, for example. Another preferred measure for keeping objects securely stored in their pockets is an embossed ridge 35 formed in back panel 11 to extend vertically from top 21 to lower line 24 in the central gap between front panels 12 and 13 at their open edges 32 and 33. Ridge 35 impedes movement of stored objects out of their pocket openings. The objects themselves, by confronting each other across the central gap, also inhibit each other from slipping out of pockets.

When envelope 10 is made by the preferred method of folding in the side edge regions of a strip of transparent resin material, front panels 12 and 13 extend below lower line 24 and across bottom region 26. They are also fused to back panel 11 along bottom edge 27 and around the edges of notches 25. This strengthens bottom region 26 and notches 25, which is also desirable.

Another workable alternative is to close three sides of each pocket by joining front panels 12 and 13 to back panel 11 along lateral sides 22 and 23, lower line 24, and a vertical line occupied by ridge 35, leaving each pocket open along top 21. Gravity tends to keep stored objects in open top pockets, which are also readily accessible without removing envelopes 10 from their guide rail file.

I claim:

1. A window envelope for a card file having a pair of parallel bottom guide rails, said envelope comprising:

a. a back panel having a top, opposite lateral sides, and a bottom region having a pair of notches fitting said rails;

b. a pair of front panels formed of transparent resin sheet material extending inward from said opposite lateral sides of said back panel;

c. said front panels being arranged relative to said back panel to form a pair of laterally adjacent pockets;

d. said front panels being joined to said back panel to close three sides of each of said pockets, leaving an open side through which objects can be inserted into said pockets to be viewed through said transparent front panels;

e. said closed sides of said pockets extending along said lateral sides of said back panel and along a lower line extending between said lateral sides above said notches in said bottom region; and f. said closed sides of said pockets extending along said top of said back panel, and said front panels being spaced apart along a gap in said central region extending vertically from said top to said bottom region.

2. The envelope of claim 1 wherein said back panel is formed with an embossed ridge extending vertically in said gap between said front panels to help retain objects in said pockets.

3. The envelope of claim 1 wherein said pockets are sized to receive 35 millimeter slide mounts.

4. The envelope of claim 1 wherein said back panel is formed of transparent resin sheet material.

5. The envelope of claim 4 wherein said front panels and said back panel are thermally fused along lines where said panels are joined.

6. The envelope of claim 5 wherein said closed sides of said pockets extend along said top of said back panel, and said front panels are spaced apart along a gap in said central region extending vertically from said top to said bottom region.

7. The envelope of claim 6 wherein said back panel is formed with an embossed ridge extending vertically in said gap between said front panels to help retain objects in said pockets.

8. The envelope of claim 1 wherein said front panels extend from said top of said back panel to a bottom edge of said bottom region of said back panel and are fused to said back panel along said bottom edge and said notches.

9. The envelope of claim 8 wherein said back panel is formed with an embossed ridge extending vertically in said gap between said front panels to help retain objects in said pockets.

10. The envelope of claim 9 wherein said pockets are sized to receive 35 millimeter slide mounts.

11. The envelope of claim 10 wherein said front panels and said back panel are thermally fused along lines where said panels are joined.

12. A method of making a window envelope for a card file having a pair of parallel bottom guide rails, said method comprising:

a. overlying a back panel with a pair of front panels formed of transparent resin material extending inward from opposite lateral sides of said back panel;

b. fusing said front panels to said back panel along a bottom region of said back panel having a pair of notches fitting said rails, along said lateral side edges of said back panel above said notches, and along one other line arranged to enclose three sides of each of a pair of laterally adjacent pockets; and c. spacing said front panels apart to leave an open gap in a central region between said opposite lateral edges and fusing said front panels to said back panel along a top of said back panel.

13. The method of claim 12 including embossing a ridge in said back panel extending vertically in said gap between said front panels.

14. The method of claim 12 including forming said back panel of transparent resin sheet material.

15. The method of claim 12 including extending said front panels from a top to a bottom of said back panel and fusing said front panels to said back panel along said bottom and around said notches.

16. The method of claim 15 including spacing said front panels apart to leave an open gap in a central region between said opposite lateral edges and fusing said front panels to said back panel along a top of said back panel.

17. The method of claim 16 including embossing a ridge in said back panel extending vertically in said gap between said front panels.

* * * * *